US005495810A

United States Patent [19]

Yoshii

[11] Patent Number: 5,495,810

[45] Date of Patent: Mar. 5, 1996

[54] CORRUGATED CARDBOARD TUBE AND PALLET USING THE SAME

[76] Inventor: Hisashi Yoshii, 1056, Natsukawa, Okayama-shi, Okayama 701-01, Japan

[21] Appl. No.: 261,123

[22] Filed: Jun. 14, 1994

[30] Foreign Application Priority Data

Jun. 14, 1993 [JP] Japan ..... 5-168593

[51] Int. Cl.[6] ..... B65D 19/00

[52] U.S. Cl. ..... 108/51.3; 108/56.3; 229/4.5

[58] Field of Search ..... 108/51.1, 51.3, 108/56.1, 56.3; 206/599, 386; 229/4.5, 202, 201

[56] References Cited

U.S. PATENT DOCUMENTS

| | | | |
|---|---|---|---|
| 2,262,242 | 11/1941 | Lenox | 229/4.5 X |
| 2,728,545 | 12/1955 | Hermitage . | |
| 2,738,153 | 3/1956 | Frase | 108/51.1 |
| 2,902,199 | 9/1959 | Breton | 108/55.1 X |
| 2,955,791 | 10/1960 | George | 108/51.1 |
| 2,978,373 | 4/1961 | Mauck et al. . | |
| 3,361,092 | 1/1968 | Budd . | |
| 3,407,758 | 10/1968 | Simkins | 108/51.3 |
| 3,683,822 | 8/1972 | Roberts et al. . | |
| 3,972,468 | 8/1976 | Reid | 229/4.5 X |
| 4,208,971 | 6/1980 | Persson | 108/51.1 |
| 4,792,325 | 12/1988 | Schmidtke . | |
| 4,831,938 | 5/1989 | Atterby et al. . | |
| 4,867,074 | 9/1989 | Quasnick . | |
| 5,388,531 | 2/1995 | Crews et al. | 108/56.3 X |

FOREIGN PATENT DOCUMENTS

| | | | |
|---|---|---|---|
| 601456 | 7/1960 | Canada | 108/51.3 |
| 701884 | 1/1965 | Canada | 229/4.5 |
| 1027765 | 5/1953 | France . | |
| 2261192 | 9/1975 | France . | |
| 2641492 | 7/1990 | France . | |
| 7211803 | 7/1972 | Germany . | |
| 695248 | 8/1953 | United Kingdom | 108/51.3 |
| 779020 | 7/1957 | United Kingdom | 108/51.3 |
| 9104196 | 4/1991 | WIPO | 108/51.1 |

*Primary Examiner*—Peter M. Cuomo
*Assistant Examiner*—Janet M. Wilkens
*Attorney, Agent, or Firm*—Birch, Stewart, Kolasch & Birch

[57] ABSTRACT

A corrugated cardboard tube includes a tubular laminar structure of single-lined corrugated cardboard which includes a plurality of strips of single-lined corrugated cardboard spirally wound into a substantially cylindrical configuration to form corresponding single-lined corrugated cardboard layers overlapping and bonded with each other in a radial direction. Each of the strips of single-lined corrugated cardboard is composed of an elongated liner sheet and a corrugated sheet, having a plurality of parallel ridges and furrows, and being spirally turned in a direction perpendicular to the ridges. The corrugated cardboard tube is used as a load bearing member adapted to support a load acting in a direction axially of the corrugated cardboard tube. The corrugated cardboard tube may also be used as leg members of a pallet and, in such case, the corrugated cardboard tubes are bonded at their opposite annular ends to upper and lower tables to complete the pallet.

9 Claims, 8 Drawing Sheets

CORRUGATED CARDBOARD TUBE AND PALLET USING THE SAME

BACKGROUND OF THE INVENTION

1. Field of the Invention

The present invention relates to a corrugated cardboard tube made of single-lined corrugated cardboard and also to a pallet using a plurality of corrugated cardboard tubes as load bearing members.

2. Description of the Prior Art

Corrugated cardboard has many features. Specifically, not only is the corrugated cardboard light-weight, but it has a high physical strength for a given weight. In addition, the corrugated cardboard has a capability of absorbing impacts and shocks. For this reason, the corrugated cardboard has long been used not only as material for various boxes, but also as material forming part or the entirety of a pallet for the support of contents thereon such as disclosed in, for example, U.S. Pat. Nos. 2,728,545, 3,683,8.22, 4,831,938, 4,792,325 and 4,867,074. Unlike multiply cardboard, the corrugated cardboard is extremely easy to be dissolved, having an excellent capability of being recycled.

FIG. 12 illustrates the prior art pallet 70 comprising upper and lower tables 71 and 72 and load bearing members or flat spacer legs 73, all of which are made of corrugated cardboard. According to the prior art, each of the upper and lower tables 71 and 72 and the flat spacer legs 73 is made up a laminar structure including a plurality of webs of double-lined corrugated cardboard 2M of a structure comprising a pair of flat liner sheets **2*b* with a corrugated sheet 2*a* sandwiched and bonded in position therebetween by the use of an adhesive material. Each flat spacer leg 73 has opposite annular end faces glued to the upper and lower tables 71 and 72 by means of a suitable adhesive material so as to receive a load, imposed by contents placed on the upper table 72, in a vertical direction A perpendicular to any one of the upper and lower tables 71 and 72**.

It has been found that each flat spacer leg 73 employed in the prior art pallet fails to make a maximized utilization of physical properties and workability of the corrugated cardboard 2M, and therefore, not only is the pallet still far from exhibiting a sufficient strength, but also the productivity is low.

In other words, each of the fiat spacer legs 73 employed in the prior art pallet is of a structure wherein a plurality of generally oblong flat webs of multiply double-lined corrugated cardboard 2M are bonded face-to-face together into a flat laminar structure, having opposite end faces bonded to the upper and lower tables 71 an 72. Therefore, the spacer legs 73 have a problem in that both of the compressive strength with respect to the vertical direction A in which the load acts, and the geometric moment of inertia with respect to their cross-section are low.

Moreover, when the fiat spacer legs 73 are to be manufactured, a plurality of oblong webs of corrugated cardboard must be laminated one by one before they are bonded together, and therefore the productivity of the fiat spacer legs 73 is low.

The prior art pallet 70 has an additional problem. When the pallet 70 is in use for transportation of contents by means of, for example, a forklift truck, the fiat spacer legs 73 is often subjected to a lateral load F applied thereto when load carrier pawls 80 of the forklift truck contact the flat spacer legs 73 as they protrude into a space between the upper and lower tables 71 and 72, or when a length of rope 90 used is tied to some or all of the fiat spacer legs 73 to pull the pallet 70. At this time, since the opposite end faces of the flat spacer legs 73 where the lateral load tends to be concentrated are firmly bonded by the bonding material to the respective liner sheets **2*b* of the innermost webs of double-lined corrugated cardboard 2M forming the respective tables 71 and 72, a so-called interlayer separation, indicated by B in FIG. 12, in which the neighboring laminated layers in the innermost liner sheet 2*b* of each table 71 or 72 are separated from each other tends to occur as the liners 2*b* are pulled laterally by the flat spacer legs 73** by the action of the lateral load F.

SUMMARY OF THE INVENTION

In order to substantially obviate the foregoing problems, the present invention provides an improved corrugated cardboard tube which may be mainly used as a load bearing member and in which a plurality of strips of single-lined corrugated cardboard of a structure having a single liner sheet and a corrugated sheet bonded to the single liner sheet, which strips are spirally wound into a substantially cylindrical configuration along a direction perpendicular to ridges of the corrugated sheet thereby to form corresponding single-lined corrugated cardboard layers that overlap and bonded with each other in a radial direction of the resultant corrugated cardboard tube.

More specifically, according to one aspect of the present invention, the corrugated cardboard tube herein provided comprises a tubular laminar structure of single-lined corrugated cardboard including a plurality of strips of single-lined corrugated cardboard spirally wound into a substantially cylindrical configuration to form corresponding single-lined corrugated cardboard layers overlapping and bonded with each other in a radial direction. Each of the strips of single-lined corrugated cardboard is composed of an elongated liner sheet and a corrugated sheet having a plurality of parallel ridges and furrows and is spirally turned in a direction perpendicular to the ridges.

To form the cylindrical configuration, the single-lined corrugated cardboard layers are bonded together in a direction radially of the corrugated cardboard tube and, therefore, when the resultant corrugated cardboard tube is used as a load bearing member for the support of a load applied thereto in a direction axially thereof, the corrugated cardboard of the present invention exhibits not only a high compressive strength, but also both of a high geometrical moment of inertia and a high rigidity. Accordingly, the present invention is effective to provide a light-weight, but robust load bearing member.

In other words, pulp material such as paper has such a characteristic that, when it is bent, it exhibits an increased strength against a load applied in a direction perpendicular to the direction along which it is bent. In the case of corrugated cardboard made up of at least two sheets of pulp material, one of the sheets of pulp material is corrugated to provide a plurality of parallel ridges and parallel furrows and, therefore, the corrugated sheet as a whole exhibits an increased strength against a compressive load applied thereto in a direction conforming to the direction of the parallel ridges or the parallel furrows whereas the other of the sheets of pulp material, that is, a liner, has a minor strength since it is not corrugated or bent in any manner whatsoever. However, in the present invention, the plurality of strips of single-lined corrugated cardboard are spirally wound so as to laminate together while representing a cylindrical configuration with the flat liners bent enough to allow them to exhibit an increased compressive strength without adversely affecting the intrinsic compressive strength of the corrugated sheets. The corrugated cardboard tube according to the present invention has been tailored to make maximum utilization of the potential strength of the single-lined corrugated cardboard material and does, therefore, has a surprisingly high compressive strength as compared with that exhibited by any paper material.

The corrugated cardboard tube which can be used as the load bearing member can be manufactured by successively winding the strips of single-lined corrugated cardboard spirally into a cylindrical configuration while an adhesive material is applied to ridges of the corrugated sheet of each single-lined corrugated cardboard layer. Thus, the corrugated cardboard tube can be manufactured at a high productivity having a high processability.

In addition, since the corrugated cardboard tube of the present invention is made of corrugated cardboard, the corrugated cardboard tube can be highly conveniently recycled. More specifically, if material for the corrugated cardboard is desired to be recovered, the corrugated cardboard tube of the present invention can readily be dissolved in contact with a solvent such as, for example, water. When the corrugated cardboard tube of the present invention is, for example, immersed in a bath of solvent, the solvent penetrates into furrows defined by the corrugated sheets that provide an increased surface area of contact with the solvent and, accordingly the corrugated cardboard tube can be quickly dissolved, leaving the original material for the corrugated cardboard tube.

According to a preferred embodiment of the present invention, when the corrugated cardboard tube is to be formed, each of the strips of single-lined corrugated cardboard is spirally wound into the cylindrical configuration so that side edges of the neighboring turns of each strip of single-lined corrugated cardboard forming the respective single-lined corrugated cardboard layer are held in abutment with, but neither overlapped nor spaced from, each other. Therefore, the strips of single-lined corrugated cardboard can be spirally wound so as to assume a right cylinder with no indentation in the vicinity of the side edges. Because of this, the corrugated cardboard tube can exhibit an increased physical strength. Moreover, since the single-lined corrugated cardboard has the flat liner only on one side of the corrugated sheet, not on both sides of the corrugated sheet, each strip of single-lined corrugated cardboard is easy to bend in a direction perpendicular to the ridges of the respective corrugated sheet at a high processability.

If in accordance with the present invention each of the strips of single-lined corrugated cardboard is wound with the corrugated sheet and the liner sheet oriented radially inwardly and radially outwardly of the corrugated cardboard tube, respectively, the corrugated sheet is deformed to allow the pitch between each circumferentially neighboring ridges to be reduced with the density of corrugation consequently increased. This allows the corrugated cardboard tube as a whole to exhibit an increased compressive strength with respect to a longitudinal direction.

The corrugated cardboard tube of the present invention may have a reinforcement member bonded to at least one of a radially outer surface of the outermost one of the single-lined corrugated layers and a radially inner surface of the innermost one of the single-lined corrugated layers. The employment of the reinforcement member contributes to a further increase in rigidity of the corrugated cardboard tube.

Preferably, the ridges of the corrugated sheet forming a part of each single-lined corrugated cardboard layer is inclined relative to a longitudinal axis of the corrugated cardboard tube. In this case, in the event that a load is applied to the corrugated cardboard tube in a direction radially thereof, a first stress acting in a direction perpendicular to the ridges of the corrugated sheets and a second stress acting in a direction parallel to the ridges of the corrugated sheets counteract the load. Accordingly, since the first stress can be reduced, the rigidity of the corrugated cardboard tube relative to an external lateral force acting thereon in a direction radially thereof can be increased, accompanied by a further increase in physical strength of the corrugated cardboard tube.

According to another aspect of the present invention, there is provided a pallet of a type utilizing the above discussed corrugated cardboard tube as a load bearing member or a spacer leg. This pallet comprises upper and lower tables, and a plurality of corrugated cardboard tubes each being of a construction as discussed hereinbefore. The corrugated cardboard tubes are, as load bearing members, positioned between the upper and lower tables with opposite annular ends of the corrugated cardboard tube bonded firmly to the upper and lower tables.

With this pallet, the load imposed by the contents placed on the upper table of the pallet acts on the corrugated cardboard tubes or spacer legs in a direction axially thereof. Accordingly, the pallet having an increased physical strength can be obtained. Moreover, since the pallet itself makes use of the corrugated cardboard tubes made of corrugated cardboard, the pallet having a lightweight feature can be obtained.

In the pallet of the above described construction, since each corrugated cardboard tube is made up of the plurality of the single-lined corrugated cardboard layers, the corrugated cardboard tube has a substantial wall thickness as measured in a direction radially thereof, accompanied by an increased annular surface area at each end of the corrugated cardboard tube. In addition, each annular end faces of the corrugated cardboard tube represents a pattern generally similar to a honeycomb pattern. Accordingly, when the opposite end faces of the corrugated cardboard tubes are to be bonded to the upper and lower tables by the use of an adhesive material to complete the pallet, the adhesive material can penetrate into perforations at the respective annular end face to stick to side faces of the corrugated sheet, accompanied by an increase in bonding strength.

According to a preferred form of the present invention, each of the upper and lower tables of the pallet comprises a flat laminar structure of corrugated cardboard including a plurality of flat web of corrugated cardboard bonded together, and having a plurality of reinforcement holes defined therein in a predetermined pattern corresponding to the shape of any of the annular end faces of each corrugated cardboard tube so as to extend inwardly thereof. Each reinforcement hole is filled with an adhesive filler material such that the annular end face of each corrugated cardboard tube can be firmly interlocked with the associated table by means of a deposit of the adhesive filler material.

Since according to the above described construction the upper and lower tables and the corrugated cardboard tubes (the load bearing members) are all made of single-lined corrugated cardboard, the pallet as a whole is extremely lightweight. Moreover, the use of the corrugated cardboard tubes having a high compressive strength permits the pallet to retain a sufficiently high physical strength. In the event that the corrugated cardboard tubes receive the load applied from lateral direction, a torsional force resulting flora the lateral load can be distributed to the upper and lower tables through the adhesive filler material filled in the reinforcement holes defined in each of the upper and lower tables. Accordingly, no concentration of the lateral load on the joints between the corrugated cardboard tubes and the upper and lower tables occurs, thereby avoiding an occurrence of an interlayer separation in which the liners are internally peeled.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like pars throughout the several views, and:

DETAILED DESCRIPTION OF THE EMBODIMENTS

Figure 1A:
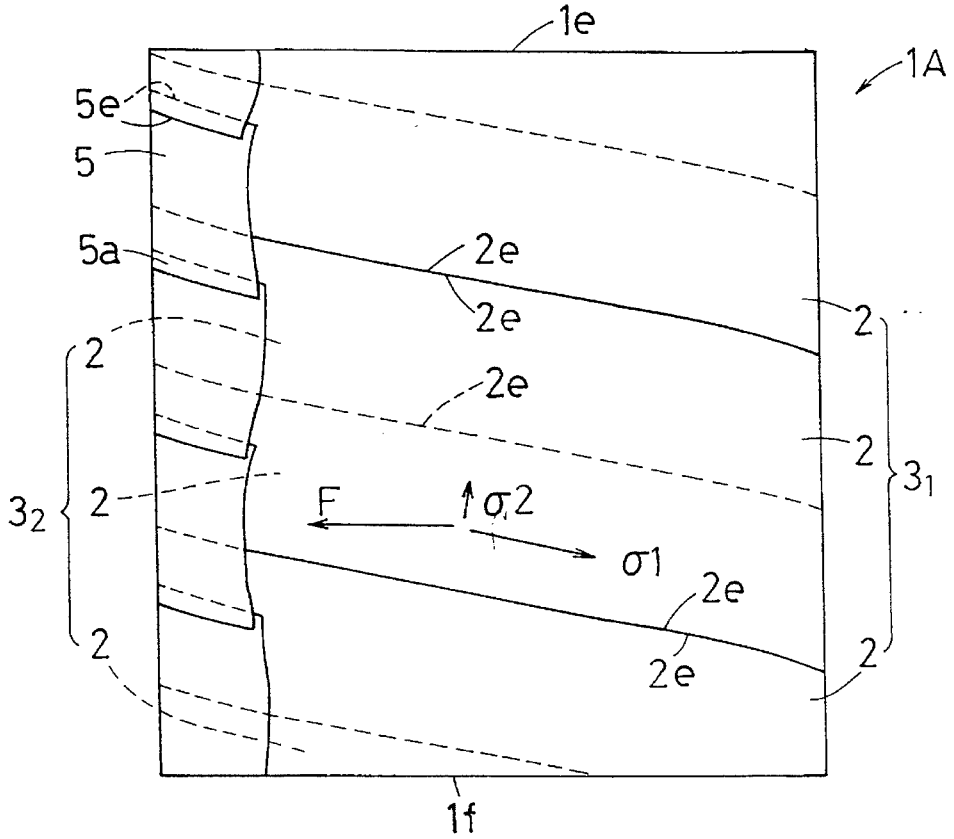
FIG. 1A is a side view, with a portion cut away, of a corrugated cardboard tube according to a first preferred embodiment of the present invention.
Figure 1B:
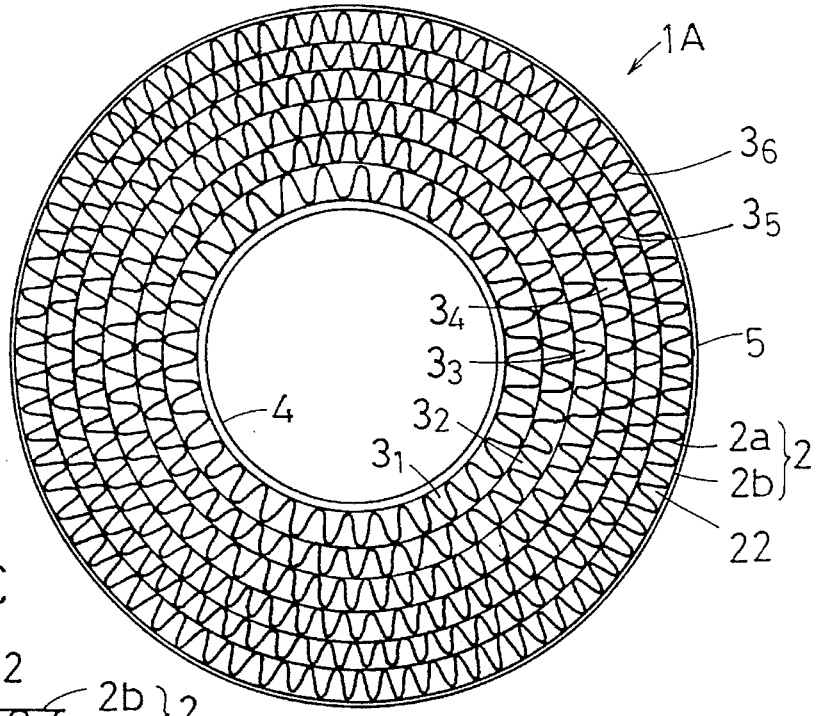
FIG. 1B is a top plan view of the corrugated cardboard tube shown in FIG. 1A.
Figure 2:
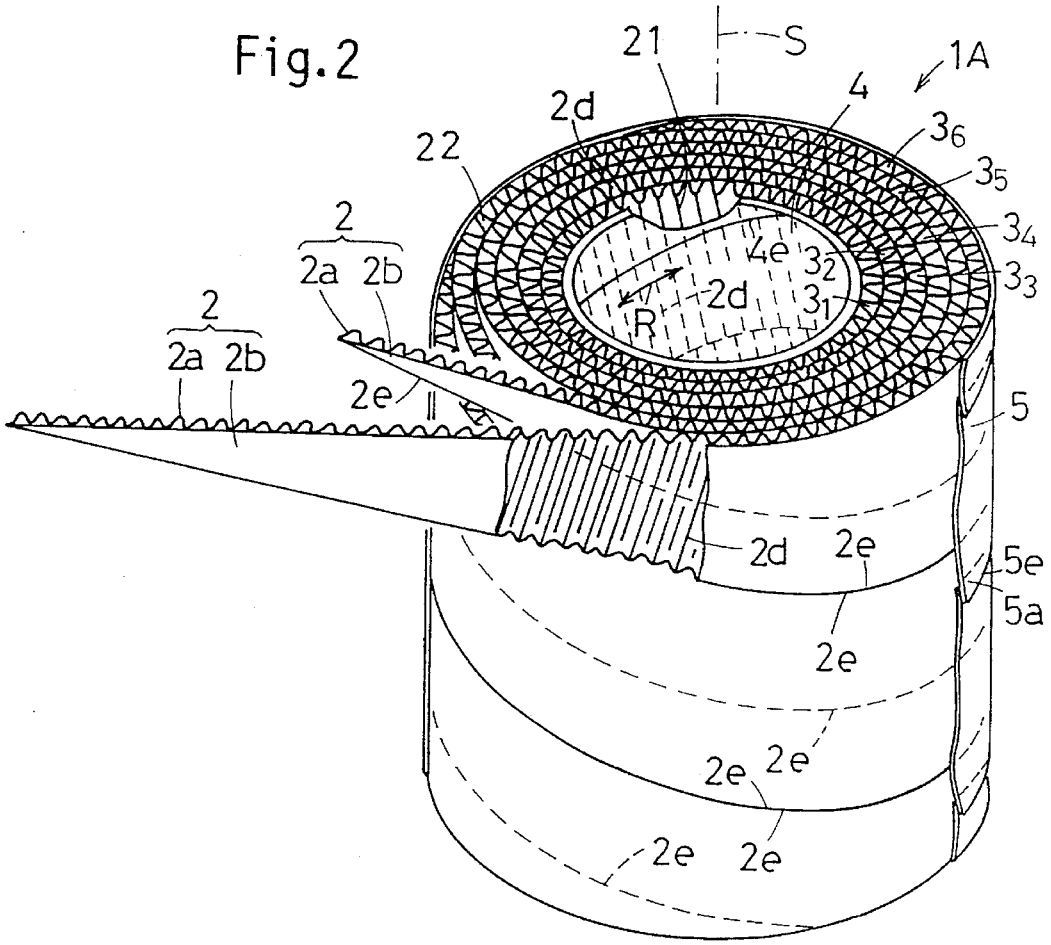
FIG. 2 is a perspective view, with a portion broken, of the corrugated cardboard tube.

A corrugated cardboard tube according to one embodiment of the present invention is generally identified by 1A in FIGS. 1A, 1B and 2 and is so designed and so configured as to be used as a tubular load bearing member. As best shown in FIG. 2, the corrugated cardboard tube 1A is formed by spirally winding a number of strips of single-lined corrugated cardboard 2 into a cylindrical configuration to provide a corresponding number of, for example, six, overlapping layers $\mathbf{3}_1$ to $\mathbf{3}_6$ of single-lined corrugated cardboard with each neighboring layers $\mathbf{3}_1$ to $\mathbf{3}_6$ glued together in a direction radially of the corrugated cardboard tube 1A. Tubular reinforcement members 4 and 5 are glued to a radially inner surface of the innermost single-lined corrugated cardboard layer $\mathbf{3}_1$ and a radially outer surface of the outermost single-lined corrugated cardboard layer $\mathbf{3}_6$, respectively. Each of the tubular reinforcement members 4 and 5 is formed by spirally winding a tape of paper into a cylindrical configuration in a number of times to provide a corresponding number of paper layers.

Figure 1C:
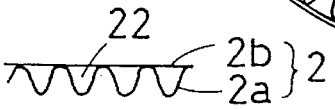
FIG. 1C is a transverse sectional view of a portion of a single-lined corrugated cardboard used as a material for the corrugated cardboard tube.
Figure 3:
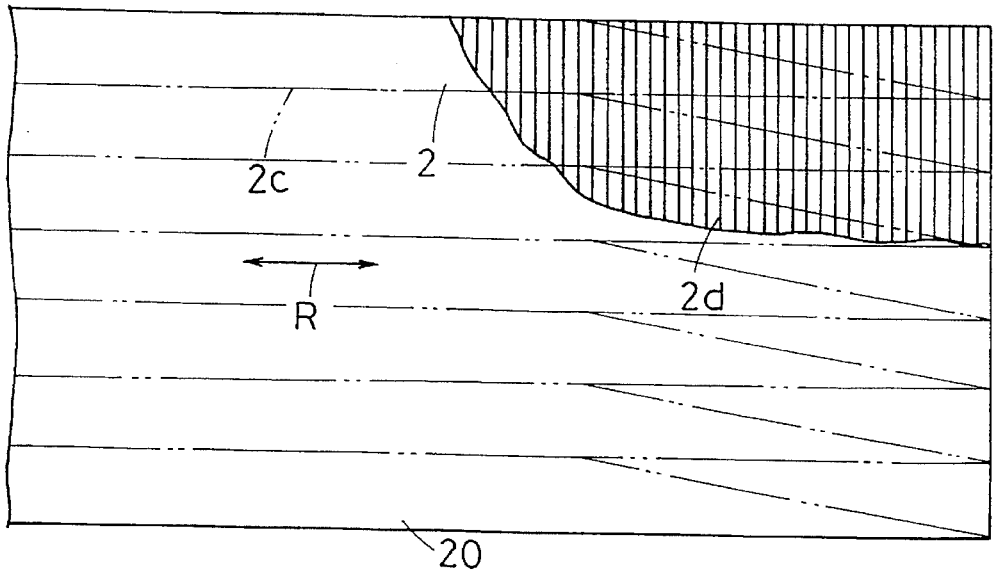
FIG. 3 is a plan view, with a portion cut away, of the single-lined corrugated cardboard used as a material for the corrugated cardboard tube.

The single-lined corrugated cardboard referred to above is of a type comprising, as best shown in FIG. 1C, a flat liner 2*b* made of pulp material such as, for example, paper, and a corrugated sheet 2*a* of pulp material such as, for example, paper, glued to the flat liner 2*b*. In order for the single-lined corrugated cardboard 2 to be utilizable in the practice of the present invention, a web of single-lined corrugated cardboard generally identified by 20 in FIG. 3 is cut along longitudinal parallel cut lines 2*c* shown by the double-dotted broken lines in FIG. 3 to provide a plurality of similar strips of single-lined corrugated cardboard 2, which cut lines 2*c* extend in a direction perpendicular to ridges or furrows defined by the corrugated sheet. Therefore, the strips of single-lined corrugated cardboard 2 used to form the corrugated cardboard tube 1A of the present invention have a lengthwise direction R extending perpendicular to the ridges 2*d*, or the furrows, of the corrugated sheet 2*a* and are spirally wound with the corrugated sheets 2*a* and the corresponding liners 2*b* oriented radially inwardly and radially outwardly, respectively, while having been bent along the lengthwise direction R perpendicular to the ridges 2*d* of the corrugated sheet 2*a*.

The single-lined corrugated cardboard 2 represents a generally corrugated cross-sectional profile when viewed in a direction perpendicular to the ridges 2*d* of the corrugated sheet 2*a*. Because of this peculiar sectional profile, the single-lined corrugated cardboard 2 will give raise to a relatively high geometrical moment of inertia when an attempt is made to bend the single-lined corrugated cardboard 2 along a direction parallel to the ridges 2*d*, but will give rise to a relatively low geometrical moment of inertia when an attempt is made to bend the single-lined corrugated cardboard 2 along a direction R perpendicular to the ridges 2*d*. Therefore, each strip of single-lined corrugated cardboard 2 is easy to be bent along the lengthwise direction R thereof which lies perpendicular to the ridges 2*d*. It is to be noted that the single-lined corrugated cardboard 2 employed in the illustrated embodiment of the present invention had an advantage in that it is easier to bend than a double-lined corrugated cardboard of a type comprising outer and inner liners with a corrugated sheet intervening therebetween as will be described later.

With the corrugated cardboard tube 1A so constructed as hereinabove described, each strip of single-lined corrugated cardboard 2 is spirally wound so that one of opposite longitudinal side edges 2*e* of one turn of the single-lined corrugated cardboard 2 is held in abutment with, and is neither spaced from nor overlapped partially with, an adjacent one of the opposite longitudinal side edges 2*e* of the next succeeding turn of the single-lined corrugated cardboard 2. Therefore, each strip of single-lined corrugated cardboard 2 so wound represents a shape of a substantially fight cylinder. A similar description applies to the inner reinforcement member 4 which is formed by spirally winding tapes of paper into a cylindrical configuration in a number of times wherein one of opposite longitudinal side edges of one turn of each paper tape is held in abutment with, and is neither spaced from nor overlapped partially with, an adjacent one of the opposite longitudinal side edges of the next succeeding turn of such paper tape. Although the outer reinforcement member 5 may be formed by spirally winding tapes of paper into a cylindrical configuration in a manner similar to the inner reinforcement member 4 with one of opposite longitudinal side edges 5*e* of one turn substantially held in abutment with an adjacent one of the opposite longitudinal side edges 5*e* of the next succeeding turn, the outer reinforcement member 5 employed in the illustrated embodiment is formed by spirally winding tapes of paper into a cylindrical configuration in a number of times wherein one of opposite longitudinal side portions 5*a* of one turn of each paper tape is overlapped partially with an adjacent one of the opposite longitudinal side portions 5*a* of the next succeeding turn of such paper tape.

On the other hand, during the winding of the strips of single-lined corrugated cardboard 2, a spiral line of abutment defined between the neighboring longitudinal side edges 2*e* of each two of the turns of one of the single-lined corrugated cardboard layers $\mathbf{3}_1$ to $\mathbf{3}_1$ 6 is displaced a predetermined distance axially of the resultant corrugated cardboard tube 1A relative to that of the next succeeding single-lined corrugated cardboard layer which is positioned immediately next to such one of the single-lined corrugated cardboard layers $\mathbf{3}_1$ to $\mathbf{3}_6$ with respect to a radial direction of the resultant corrugated cardboard tube 1A. At the same time, the corrugated sheet 2*a* of the strip of single-lined corrugated cardboard 2 forming one single-lined corrugated cardboard layer has top portions 21 or the ridges 2*d* which are glued to the flat liner 2*b* of the strip of single-lined corrugated cardboard 2 forming the next succeeding single-lined corrugated cardboard layer by the use of an adhesive material. Thus, it will readily be seen that each single-lined corrugated cardboard layer $\mathbf{3}_1$ to $\mathbf{3}_6$ retains a cylindrical shape.

By way of example, the spiral line of abutment between the neighboring longitudinal side edges 2*e* of the turns of the strip of single-lined corrugated cardboard 2 forming the outermost single-lined corrugated cardboard layer $\mathbf{3}_6$ does not overlap with, and is offset a predetermined distance axially of the corrugated cardboard tube 1A relative to, the line of abutment between the neighboring longitudinal side edges 2*e* of the turns of the strip of single-lined corrugated cardboard 2 forming the single-lined corrugated cardboard layer $\mathbf{3}_5$ which is positioned radially inwardly of the outermost single-lined corrugated cardboard layer $\mathbf{3}_6$ with the top portions 21 of the corrugated sheet 2*a* in the outermost single-lined corrugated cardboard layer $\mathbf{3}_6$ glued to the flat liner 2*b* in such single-lined corrugated cardboard layer $\mathbf{3}_5$, allowing each of the single-lined corrugated cardboard layers $\mathbf{3}_5$ and $\mathbf{3}_6$ to represent a cylindrical shape. A description similar to the above made in connection with the relationship between the single-lined corrugated cardboard layers $\mathbf{3}_6$ and $\mathbf{3}_5$ equally applies to a relationship between the single-lined corrugated cardboard layers $\mathbf{3}_5$ and $\mathbf{3}_4$, between the single-lined corrugated cardboard layers $\mathbf{3}_4$ and $\mathbf{3}_3$, between the single-lined corrugated cardboard layers $\mathbf{3}_3$ and $\mathbf{3}_2$, and between the single-lined corrugated cardboard layers $\mathbf{3}_2$ and $\mathbf{3}_1$.

The corrugated cardboard tube 1A of the construction shown in and described with reference to FIGS. 1A to 1C and 2 is, when desired to be used as load bearing member or spacer legs in a pallet for the support of contents thereon, cut into a plurality of tubular corrugated cardboard legs of an equal length. Alternatively, the corrugated cardboard tube 1A may be manufactured having a relatively small length intended for use as a load bearing member or spacer leg in a pallet. In either case, in describing the pallet utilizing the corrugated cardboard tubes 1A of the present invention, the same reference numeral used to denote the corrugated cardboard tube 1A is used to denote the load bearing member or spacer leg.

Figure 4A:
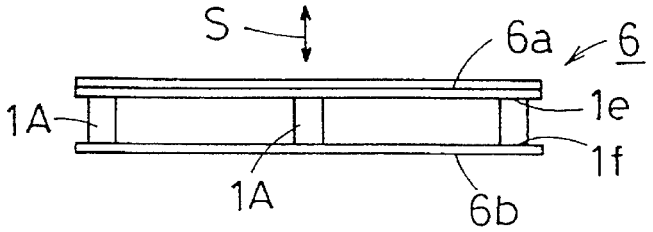
FIG. 4A is a schematic side view of a pallet including load bearing members each made of the corrugated cardboard tube of the present invention.
Figure 4B:
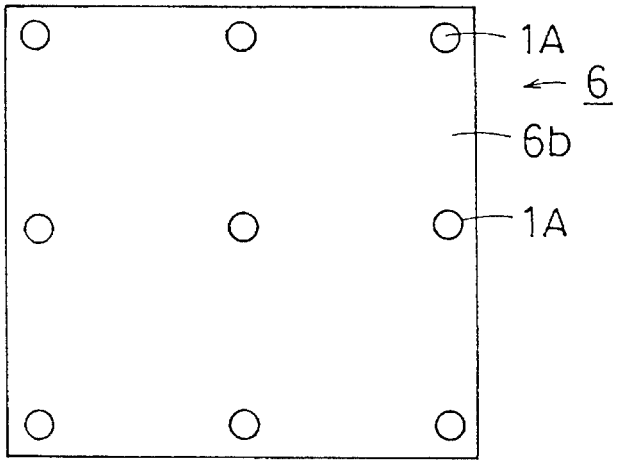
FIG. 4B is a top plan view, with an upper table removed, of the pallet shown in FIG. 4A.
Figure 4C:
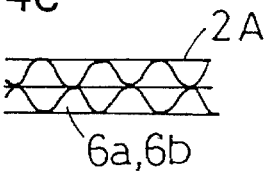
FIG. 4C is a transverse sectional view of a portion of a multiply double-lined corrugated cardboard used as an example of material for both of upper and lower tables of the pallet.
Figure 4D:
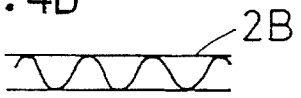
FIG. 4D is a transverse sectional view of a portion of a double-lined corrugated cardboard used as another example of material for both of upper and lower tables of the pallet.

Referring now to FIGS. 4A and 4B, the pallet identified by 6 comprises an upper table 6*a* and a lower table 6*b* with a plurality of, for example, nine, spacer legs 1A interposed therebetween. Each of the spacer legs 1A has its opposite ends 1e and If bonded to the upper and lower tables 6*a* and 6*b* , respectively. Although one or both of the upper and lower tables 6*a* and 6*b* of the pallet 6 may be in the form of a wood plate, each of the upper and lower tables 6*a* and 6*b* of the pallet 6 according to the present invention is preferably in the form of a generally rectangular plate of either multiply double-lined corrugated cardboard 2A as shown in FIG. 4C or double-lined corrugated cardboard 2B as shown in FIG. 4D. This is particularly advantageous in that the pallet 6 as a whole can be manufactured having an extremely light-weight feature. It is to be noted that the multiply double-lined corrugated cardboard 2A referred to above and shown in FIG. 4C is of a structure which may be considered having two single-lined corrugated cardboards glued together with an interliner intervening between the respective corrugated sheets of the single-lined corrugated cardboards and the double-lined corrugated cardboard 2B is of a structure comprising two flat liners with a corrugated sheet intervening therebetween and glued to the flat liners.

Figure 4E:
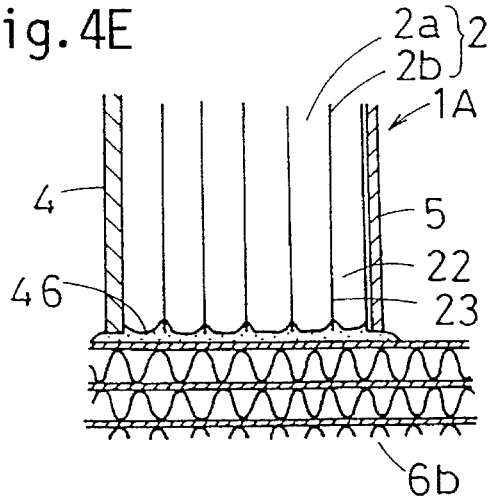
FIG. 4E is a fragmentary longitudinal sectional view, on an enlarged scale, of the pallet showing a joint between one of the upper and lower tables and the load beating members.

Thus, it will readily be seen that, since the corrugated cardboard tube 1A is of a structure including the plurality of the single-lined corrugated cardboard layers $\mathbf{3}_1$ to $\mathbf{3}_6$ each made of the strip of single-lined corrugated cardboard 2, the corrugated cardboard tube 1A has a relatively great wall thickness as measured in a radial direction thereof and also has opposite annular end faces of a relatively large surface area. Each of the opposite annular end faces of the corrugated cardboard tube 1A has a multiplicity of perforations, generally identified by 22 in FIG. 1) defined by the furrows in the corrugated sheets 2*a* as if representing a pattern substantially similar to a honeycomb structure and, therefore, when each tubular corrugated cardboard leg, that is, each corrugated cardboard tube 1A, is secured at each end thereof to any one of the upper and lower tables 6*a* and 6*b* by the use of a bonding material, the bonding material penetrates into the perforations 22 as best shown in FIG. 4E and then sticks to side faces of respective ends of the corrugated sheets 2*a* adjacent the upper or lower table 6*a* and 6*b*. The consequence is that the surface area of adhesion between each annular end of the tubular corrugated cardboard leg or corrugated cardboard tube 1A and the associated upper or lower tables 6*a* or 6*b* is increased enough to increase a bonding strength.

If desired, each of the upper and lower tables 6*a* and 6*b* of the pallet 6 as well as an outer peripheral surface of each of the tubular corrugated cardboard leg or corrugated cardboard tube 1A may either have a water-resistant or water-repellent sheet lined thereon, or be treated, or otherwise coated, with a water-repellent agent.

When in use, the tubular corrugated cardboard legs 1A of the pallet 6 support a load acting in an axial direction S thereof upon placement of contents (not shown) on, for example, the upper table 6*a*. Since as indicated above each tubular corrugated cardboard leg 1A includes the strips of single-lined corrugated cardboard 2 spirally wound and then bonded together to provide the single-lined corrugated cardboard layers $\mathbf{3}_1$ to $\mathbf{3}_6$, thereby providing a tubular laminar structure of single-lined corrugated cardboard material, each tubular corrugated cardboard leg 1A can exhibit not only an increased compressive strength in the axial direction S, but also both of an increased geometrical moment of inertia with respect to the cross-section thereof and an increased bending rigidity as compared with those exhibited by the prior art load beating member. Thus, since the maximized utilization has been made of physical properties of the single-lined corrugated cardboard material, the tubular corrugated cardboard legs 1A used in the pallet 6 is very light-weight and robust in strength.

In general, pulp material such as paper has such a characteristic that, when it is bent, it exhibits an increased strength against a load applied in a direction perpendicular to the direction along which it is bent. In the case of the corrugated cardboard material comprised of at least two sheets of pulp material, one of the sheets of pulp material is corrugated to provide a plurality of parallel ridges and parallel furrows and, therefore, the corrugated sheet as a whole exhibits an increased strength against a compressive load applied thereto in a direction conforming to the direction of the parallel ridges or the parallel furrows whereas the other of the sheets of pulp material, that is, a liner, has a minor strength since it is not corrugated or bent in any manner whatsoever.

In the practice of the present invention, however, a plurality of strips of single-lined corrugated cardboard 2 are spirally wound so as to laminate together while representing a cylindrical configuration as clearly shown in FIG. 2, the flat liners 2*b* are also bent enough to allow them to exhibit an increased compressive strength without adversely affecting the intrinsic compressive strength of the corrugated sheets 2*a*. Accordingly, each tubular corrugated cardboard leg or corrugated cardboard tube 1A according to the present invention is effective to exhibit an extremely high compressive strength. Each tubular corrugated cardboard leg or corrugated cardboard tube 1A according to the present invention which is made of the plurality of strips of single-lined corrugated cardboard 2 has been tailored to make maximum utilization of the potential strength of the single-lined corrugated cardboard material and, therefore, has a surprisingly high compressive strength as compared with that exhibited by any paper material.

In addition, in the illustrated embodiment, since the strips of single-lined corrugated cardboard 2 are spirally wound so that each corrugated sheet 2*a* thereof and the associated flat liner 2*b* thereof are positioned radially inwardly and radially outwardly of the resultant corrugated cardboard tube 1A, respectively, the corrugated sheet 2*a* has been deformed to allow the pitch between each circumferentially neighboring top portions 21 or the ridges 2*d* to be reduced with the density of corrugation consequently increased. This allows the corrugated cardboard tube 1A as a whole to exhibit an increased compressive strength.

Also, since in the corrugated cardboard tube 1A the side edges 2*e* of the neighboring turns of each strip of single-lined corrugated cardboard 2 forming the respective single-lined corrugated cardboard layer $\mathbf{3}_1$ to $\mathbf{3}_6$ are held in abutment with each other, each strip of single-lined corrugated cardboard 2 can be wound into a right cylinder (i.e., each single-lined corrugated cardboard layer $\mathbf{3}_1$ to $\mathbf{3}_6$ can be configured so as to represent a fight cylinder) even though it has a substantial thickness as compared with a standard cardboard and, therefore, the corrugated cardboard tube 1A can have an increased physical strength.

Considering that the single-lined corrugated cardboard 2 when brought into contact with a solvent such as, for example, water is easy to dissolve, the single-lined corrugated cardboard 2 can be recycled as material for corrugated cardboard and is, therefore, considered having a high resource-saving effect. When the single-lined corrugated cardboard 2, when desired to be discarded or disposed of, is immersed in the solvent, for example, a water bath, the solvent penetrates into the perforations 22 defined by the furrows of the corrugated sheets. Accordingly, since the surface area of contact of material of the single-lined corrugated cardboard 2 with the solvent increases, the tubular corrugated cardboard legs, that is, the corrugated cardboard tubes 1A, can readily be dissolved, leaving material for the corrugated cardboard within the solvent.

Yet, since the inner surface of the innermost single-lined corrugated cardboard layer $\mathbf{3}_1$ and the outer surface of the outermost single-lined corrugated cardboard layer $\mathbf{3}_6$ are bonded to the tubular reinforcement members 4 and 5, respectively, the rigidity of the corrugated cardboard robe 1A is further increased accompanied by an increase in physical strength. It is to be noted that, in the practice of the present invention, either one of the inner and outer reinforcement members 4 and 5 may be dispensed with, without being substantially accompanied by a reduction in physical strength of the corrugated cardboard tube 1A.

Moreover, in the corrugated cardboard tube 1A of the present invention, the ridges 2*d* of the corrugated sheets 2*a* are inclined relative to the axial direction S of the corrugated cardboard tube 1A. Therefore, in the event that a load F is applied to the corrugated cardboard tube 1A in a direction radially thereof as shown in FIG. 1, a first stress $\sigma 1$ acting in a direction perpendicular to the ridges 2*d* (FIG. 3) of the corrugated sheets 2*a* and a second stress $\sigma 2$ acting in a direction parallel to the ridges 2*d* of the corrugated sheets 2*a* counteract the load F. Accordingly, since the first stress $\sigma 1$ can be reduced, the rigidity of the corrugated cardboard tube 1A relative to an external lateral force acting thereon in a direction radially thereof, that is, the lateral load described with reference to FIG. 12, can be increased, accompanied by a further increase in physical strength of the corrugated cardboard tube 1A.

Figure 5:
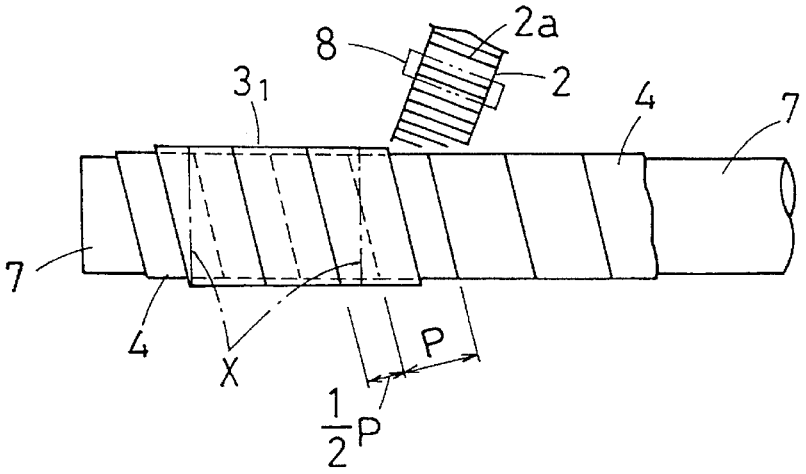
FIG. 5 is a schematic top plan view showing a method of making the corrugated cardboard tub&.

FIG. 5 illustrates an example of an apparatus for manufacturing the corrugated cardboard tube 1A according to the present invention. The apparatus shown therein comprises a fixedly supported mandrel 7 and an adhesive applicator 8 supported for movement in a direction axially of and relative to the fixedly supported mandrel 7. To manufacture the corrugated cardboard tube 1A, a drive belt (not shown) is driven to spirally wind, in plural plies, the tapes of paper around the fixedly supported mandrel 7 with the drive belt being in contact with the outer surface of the tapes of paper to form the inner reinforcement member 4. The tapes of paper forming the inner reinforcement member 4 may be made of pulp material identical with that of the flat liners 2*a*.

Thereafter, a strip of single-lined corrugated cardboard 2, which eventually form the innermost single-lined corrugated cardboard layer $\mathbf{3}_1$, is spirally wound around the inner reinforcement member 4. At this time, care must be taken that the strip of single-lined corrugated cardboard 2 forming the innermost single-lined corrugated cardboard layer $\mathbf{3}_1$ should be spirally wound with its turns having a winding pitch which is axially displaced a distance corresponding to half the pitch P (any other distance such as one third of the pitch P is possible) of helix of the inner reinforcement member 4. As the winding of the strip of single-lined corrugated cardboard 2 progresses, the adhesive applicator 8 is moved axially of the mandrel 7 while applying the bonding material to the inner surface of the corrugated sheet 2*a* of the strip of single-lined corrugated cardboard 2 being wound spirally around the mandrel 7 through the innermost reinforcement member 4. After the complete winding of the strip of single-lined corrugated cardboard 2 to form the innermost single-lined corrugated cardboard layer $\mathbf{3}_1$, the second to sixth (outermost) single-lined corrugated cardboard layers $\mathbf{3}_2$ to $\mathbf{3}_6$ are successively formed in a manner similar to that described in connection with the formation of the innermost single-lined corrugated cardboard layer $\mathbf{3}_1$.

After the formation of the tubular laminar structure of single-lined corrugated cardboard including the six single-lined corrugated cardboard layers $\mathbf{3}_1$ to $\mathbf{3}_6$ spirally wound around the inner reinforcement member 4, the outer reinforcement member 5 is spirally wound around to the tubular laminar structure while being glued to the outer peripheral surface of the outermost single-lined corrugated cardboard layer $\mathbf{3}_6$, thereby completing a length of corrugated cardboard tube 1A. The outer reinforcement member 5 is similar in structure to the inner reinforcement member 4 and is composed of a plurality of tapes of paper spirally wound into a cylindrical configuration. The length of corrugated cardboard tube so formed may be subsequently cut along a single-dotted line X to a desired length, thereby providing the corrugated cardboard tube 1A of a shape shown in FIGS. 1A and 1B.

It is to be noted that, in the practice of the present invention, although each of the inner and outer reinforcement members 4 and 5 has been shown and described as formed of a plurality of tapes of paper spirally wound into the cylindrical configuration, an oblong sheet of paper having a length equal to the axial length of the corrugated cardboard tube 1A may be wound around and glued to the tubular laminar structure of single-lined corrugated cardboard.

Since the corrugated cardboard tube 1A is of the tubular laminar structure of single-lined corrugated cardboard including the six single-lined corrugated cardboard layers $\mathbf{3}_1$ to $\mathbf{3}_6$ wound around the inner reinforcement member 4 into the cylindrical configuration, it can readily be manufactured by applying the bonding material by means of the adhesive applicator 8 while the strips of single-lined corrugated cardboard 2 are successively spirally wound around the mandrel 7 through the inner reinforcement member 4, accompanied by an increased productivity. Also, since the corrugated cardboard tube 1A is made of material such as the strips of single-lined corrugated cardboard 2, and since the material for the corrugated cardboard tube 1A is flexible as compared with the double-lined corrugated cardboard 2B in which, as shown in FIG. 4D, the corrugated sheet 2*a* is sandwiched between the flat liners 2*b*, the strips of single-lined corrugated cardboard 2 can easily be bent to wrap in the direction R perpendicular to the ridges 2*d* of the corrugated sheet 2*a*, accompanied by an increased processability.

Figure 6:
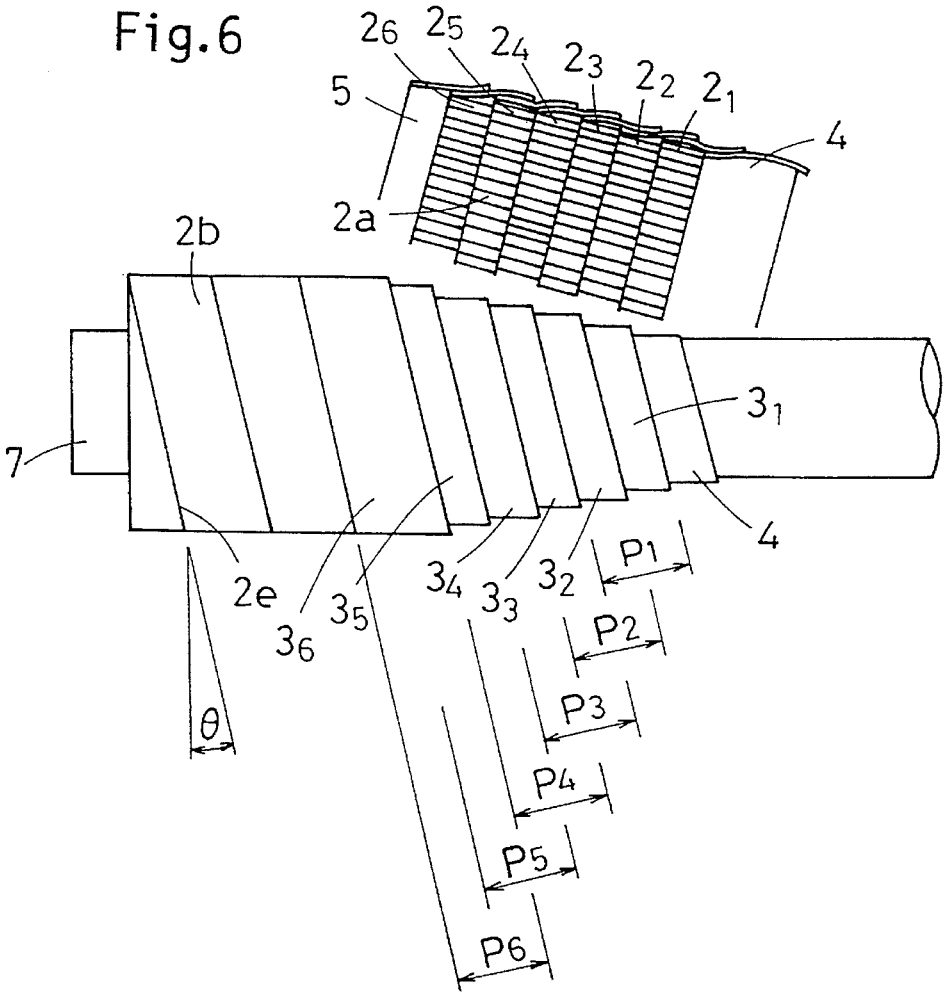
FIG. 6 is a schematic top plan view showing another method of making the corrugated cardboard tube.

FIG. 6 illustrates another example of the apparatus for manufacturing the corrugated cardboard tube 1A in accordance with the present invention. In FIG. 6, the inner reinforcement member 4, the plural strips $\mathbf{2}_1$ to $\mathbf{2}_6$ of single-lined corrugated cardboard and the outer reinforcement member 5 are prepared beforehand in a manner partially overlapped fashion while spaced a distance corresponding, for example, to half or one third the pitch P of helix so that they can be subsequently turned parallel around the mandrel 7. Accordingly, the angle of inclination θ of each side edge 2*e* of the turns of each strip of single-lined corrugated cardboard forming the respective single-lined corrugated cardboard layer $\mathbf{3}_1$ to $\mathbf{3}_6$ remain the same over the entire length of the corrugated cardboard tube 1A. It is to be noted that, as is the case with the manufacturing method described with particular reference to FIG. 5, each of the inner and outer reinforcement members 4 and 5 may be wound around the tubular laminar structure separate from the winding process in which the strips of single-lined corrugated cardboard are spirally wound.

Assuming that the diameter of the flat liner 2*b* in each single-lined corrugated cardboard layer $\mathbf{3}_1$ to $\mathbf{3}_6$ is expressed by ϕn and the width of each strip of single-lined corrugated cardboard 2 is expressed by Pn, the following relationship establishes in order for the side edges 2*e* of the turns in each single-lined corrugated cardboard layer $\mathbf{3}_1$ to $\mathbf{3}_6$ to be held in abutment with each other in the axial direction of the subsequently formed corrugated cardboard tube 1A.

$$\pi\phi n \cdot \sin\theta = Pn \quad (1)$$

Since the diameter ϕn of the particular single-lined corrugated cardboard layer $\mathbf{3}_1$, $\mathbf{3}_2$, $\mathbf{3}_3$, $\mathbf{3}_4$, $\mathbf{3}_5$ or $\mathbf{3}_6$ increases as the number of the strips of single-lined corrugated cardboard 2 which have been spirally wound increases, the width Pn of each strip of single-lined corrugated cardboard progressively increases with an increase in diameter ϕn of the particular single-lined corrugated cardboard layer $\mathbf{3}_1$, $\mathbf{3}_2$, $\mathbf{3}_3$, $\mathbf{3}_4$, $\mathbf{3}_5$ or $\mathbf{3}_6$, that is, $P_6>P_5>P_4>P_3>P_2>P_1$. The corrugated cardboard tube 1A in which the relationship of $P_6>P_5>P_4>P_3>P_2>P_1$ is established allows the plurality of the single-lined corrugated cardboard layers $\mathbf{3}_1$ to $\mathbf{3}_6$ to be formed simultaneously, exhibiting a superior manufacturability.

Figure 7:
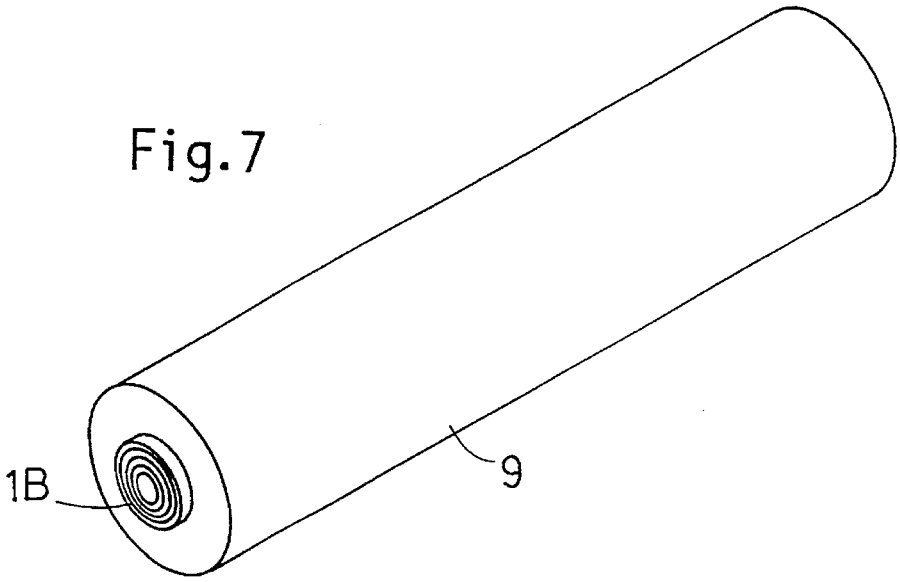
FIG. 7 is a schematic perspective view showing an example of applications of the corrugated cardboard tube of the present invention.

The web of single-lined corrugated cardboard 20 (FIG. 3) of a desired length as measured in a direction conforming to the direction R perpendicular to the ridges 2*d* can readily be obtained by connecting a roll of single-lined corrugated cardboard with another roll of single-lined corrugated cardboard when one roll of single-lined corrugated cardboard has been consumed, and therefore, the corrugated cardboard tube 1A of any desired length as measured in the direction axially of the corrugated cardboard tube 1A can be formed. If the corrugated cardboard 1A is formed having a desired or required length, the resultant corrugated cardboard 1A can be used as a tubular core member 1B around which a strip of film 9 is turned as shown in FIG. 7. Even though the corrugated cardboard 1A is used as the tubular core member 1B for the support of the strip of film 9 therearound, the tubular core member 1B exhibits a physical strength sufficient to withstand the lateral force acting thereon in a direction radially thereof and will not therefore deform when the strip of film 9 is tightly wound therearound.

Figure 8A:
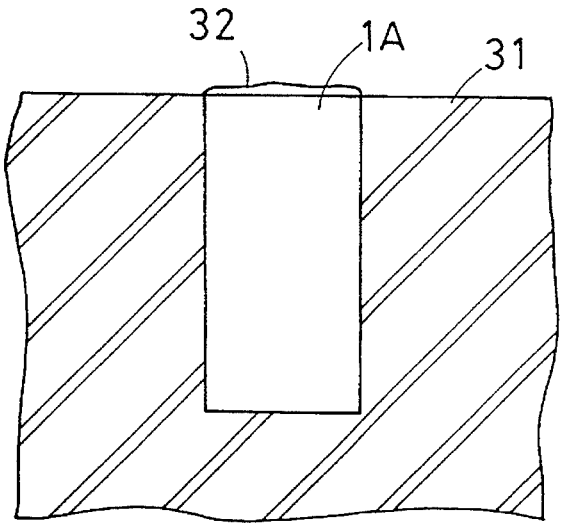
FIG. 8A is a longitudinal sectional view showing another example of applications of the corrugated cardboard tube.
Figure 8B:
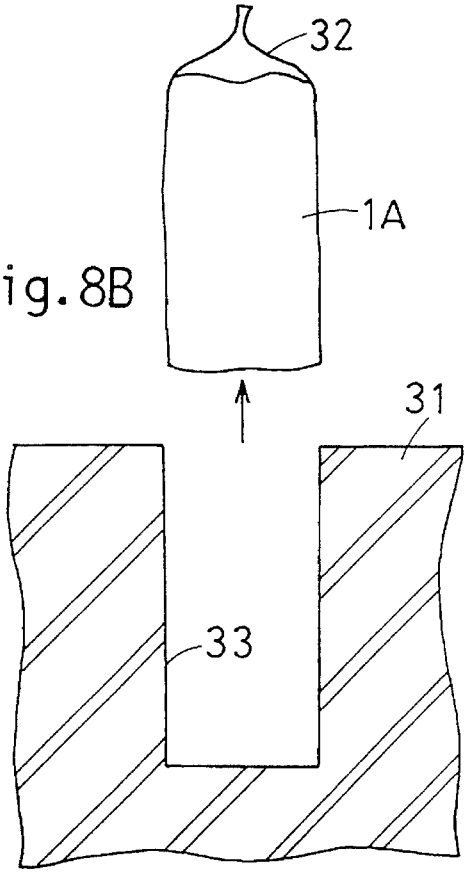
FIG. 8B is a longitudinal sectional view showing how the corrugated cardboard tube shown in FIG. 8A is applied.

As shown in FIGS. 8A and 8B, the corrugated cardboard tube 1A according to the present invention can also be used as a bore forming member for the formation of a bore on a road or floor which may be used to receive a pole for the support of a traffic sign, a guide rail or a machine. Referring first to FIG. 8A, where a ground 31 such as, for example, a road or a floor is to be formed of concrete, the corrugated cardboard tube 1A is wrapped with a vinyl bag 32 and is then installed at a desired site, followed by casting of concrete material. After the concrete material so cast has been hardened, a solvent such as, for example, water is poured into the bag 32 wrapping the corrugated cardboard tube 1A to allow the corrugated cardboard tube 1A to be softened or dissolved. When as shown in FIG. 8B the bag 32 containing the corrugated cardboard tube 1A so softened or dissolved is pulled outwardly from the concrete-covered ground 31, a blind hole 33 is left in the concrete-covered ground 31. The blind hole 33 so formed may be used for the erection of any suitable pole. It is to be noted that, since the corrugated cardboard tube 1A exhibits a sufficient physical strength resisting to the lateral load imposed by the poured concrete material in the radially inward direction thereof, the corrugated cardboard tube 1A does not deform by the effect of a pressure developed by the concrete material and leaves the blind hole 33 of a desired configuration corresponding to the shape of the corrugated cardboard tube 1A.

If the corrugated cardboard tube 1A of the present invention which is made of corrugated cardboard is employed as the hole forming member, the latter can easily and readily be softened or dissolved by the use of the solvent as compared with the use of a hole forming member made of paper wound in a plurality of plies, and therefore, removal of the hole forming member according to the present invention is easy to achieve.

Figure 9:
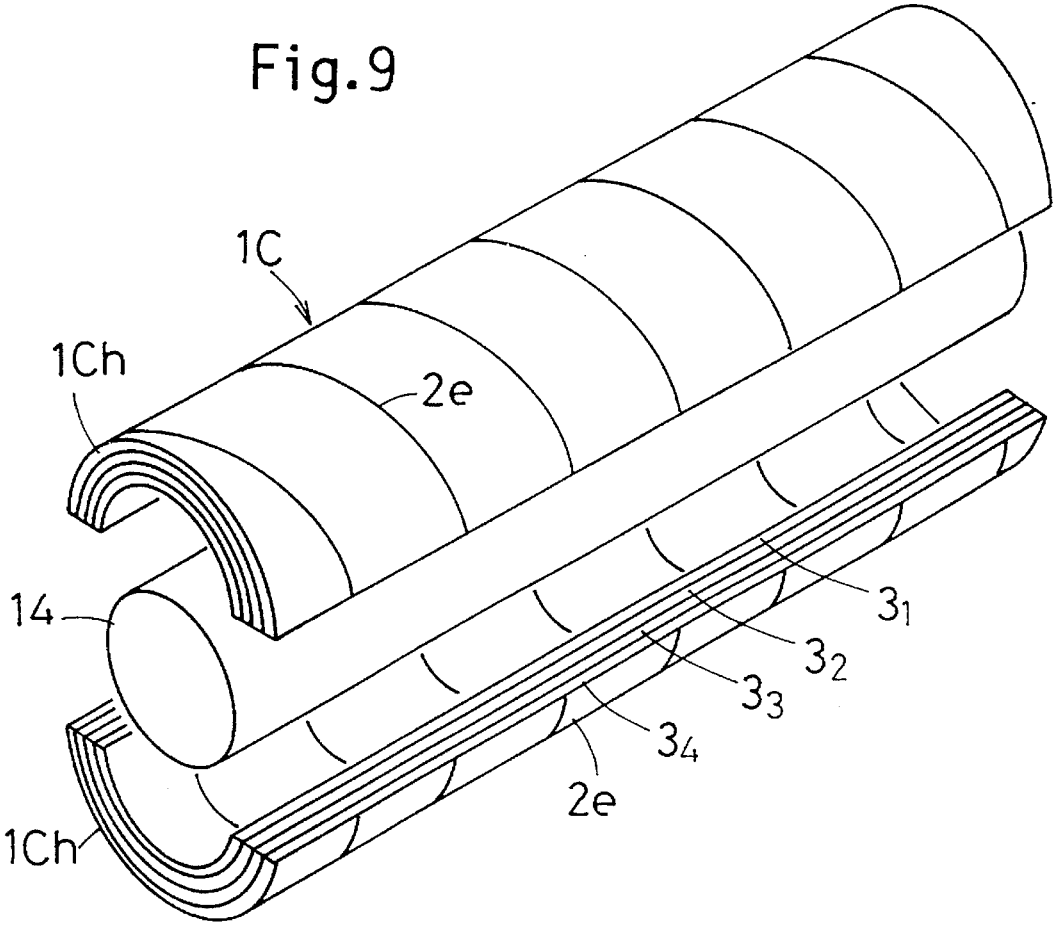
FIG. 9 is a perspective view showing a further example of applications of the corrugated cardboard tube.

Also, as shown in FIG. 9, if the corrugated cardboard tube, now identified by 1C, of the present invention having a substantial length is divided along a plane parallel to and containing the longitudinal axis thereof into two corrugated cardboard tube halves 1Ch having a semi-circular cross-sectional shape, the corrugated cardboard tube halves 1Ch can be used as a wrapping or protective sheath so that, for example, a metal shaft 14 can be wrapped or protected from external foreign matter.

In the foregoing embodiment of the present invention, the strips of single-lined corrugated cardboard 2 have been described and shown as would into the cylindrical configuration with the corrugated sheets 2*a* and the flat lines 2*b* oriented radially inwardly and radially outwardly of the resultant corrugated cardboard tube 1A, respectively. In the practice of the present invention, however, the strips of single-lined corrugated cardboard 2 may be wound into the cylindrical configuration with the corrugated sheets 2*a* and the flat lines 2*b* oriented radially outwardly and radially inwardly of the resultant corrugated cardboard tube 1A, respectively. Even in this case, in the outermost single-lined corrugated cardboard layer $\mathbf{3}_6$, the corrugated sheet 2*a* thereof are exposed to the outside and, therefore, the use of the outer reinforcement member 5 having a substantial thickness is recommended while the use of the inner reinforcement member 4 may be or may not be essential.

Also, the use of the six single-lined corrugated cardboard layers $\mathbf{3}_1$ to $\mathbf{3}_6$ in the foregoing embodiment of the present invention is only for the purpose of illustration and, therefore, seven or more single-lined corrugated cardboard layers may be employed for the corrugated cardboard tube 1A of the present invention. More specifically, the use of at least two single-lined corrugated cardboard layers meets the requirements of the present invention, and the actual number of the single-lined corrugated cardboard layers may be chosen depending on and/or in consideration of the purpose for which the corrugated cardboard tube 1A of the present invention is used.

When the pallet 6 assembled with the use of the corrugated cardboard tubes 1A according to the foregoing embodiment of the present invention is to be discarded or disposed of, the upper and lower tables 6*a* and 6*b* and the tubular corrugated cardboard legs 1A, all forming the pallet 6, can easily be separated merely by hammering into waste material which should not be bulky.

Figure 11:
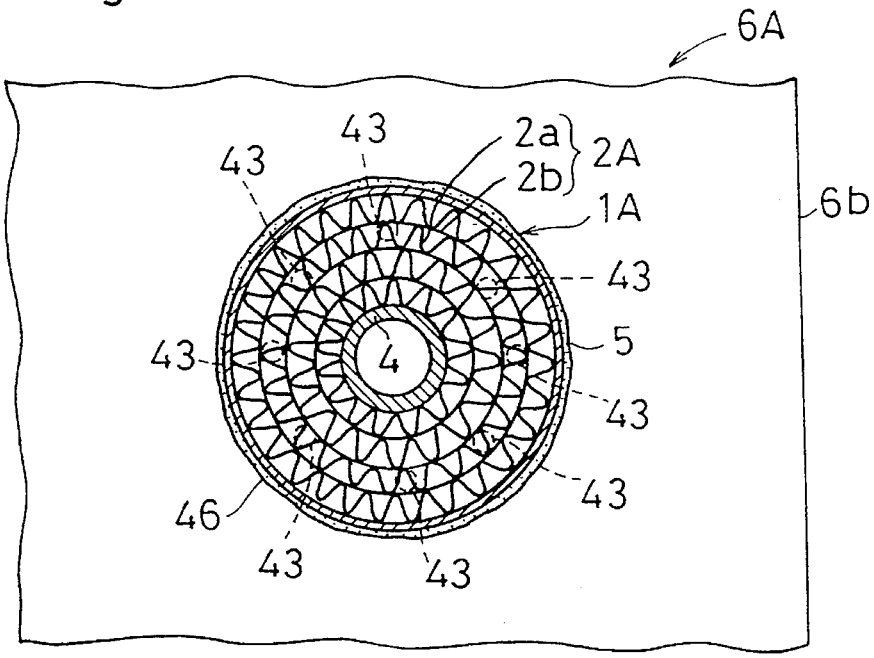
FIG. 11 is a cross-sectional view taken along the line XI—XI in FIG. 10.
Figure 12:
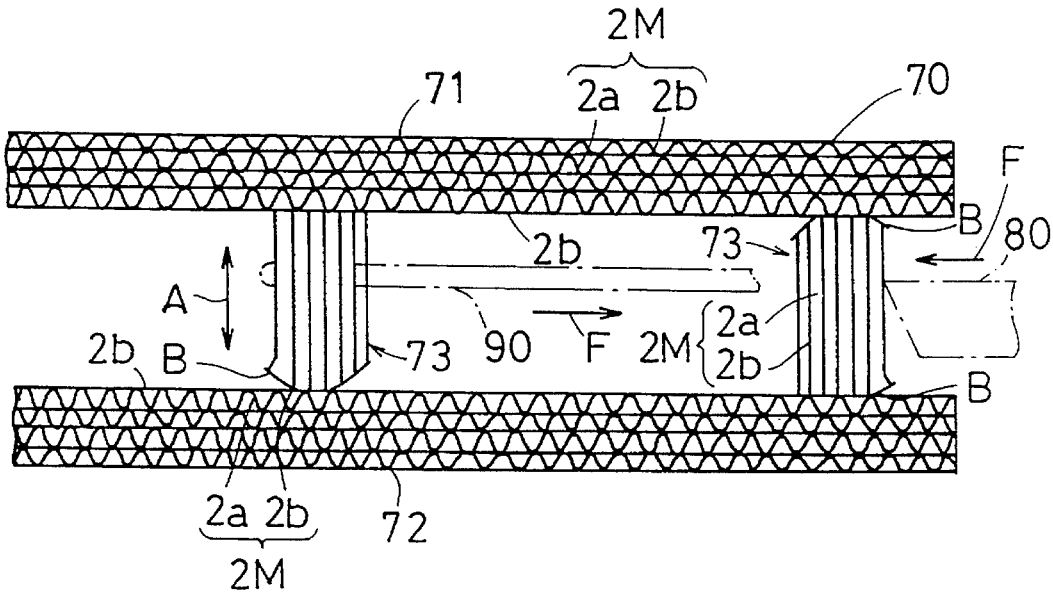
FIG. 12 is a longitudinal sectional view of the prior art pallet utilizing a corrugated cardboard.

It may occur that, since the pallet 6 is of a structure wherein the tubular corrugated cardboard legs, that is, the corrugated cardboard tubes 1A, are firmly bonded at their opposite ends to the upper and lower tables 6*a* and 6*b*, respectively, an interlayer separation shown by B in FIG. 12 may occur at the joints between the ends of the tubular corrugated cardboard legs 1A and the upper and lower tables 6*a* and 6*b* when the pallet 6 receives the lateral load acting from lateral direction thereof. An improved pallet 6A shown in FIGS. 10 and 11 is effective to substantially eliminate this problem.

Figure 10:
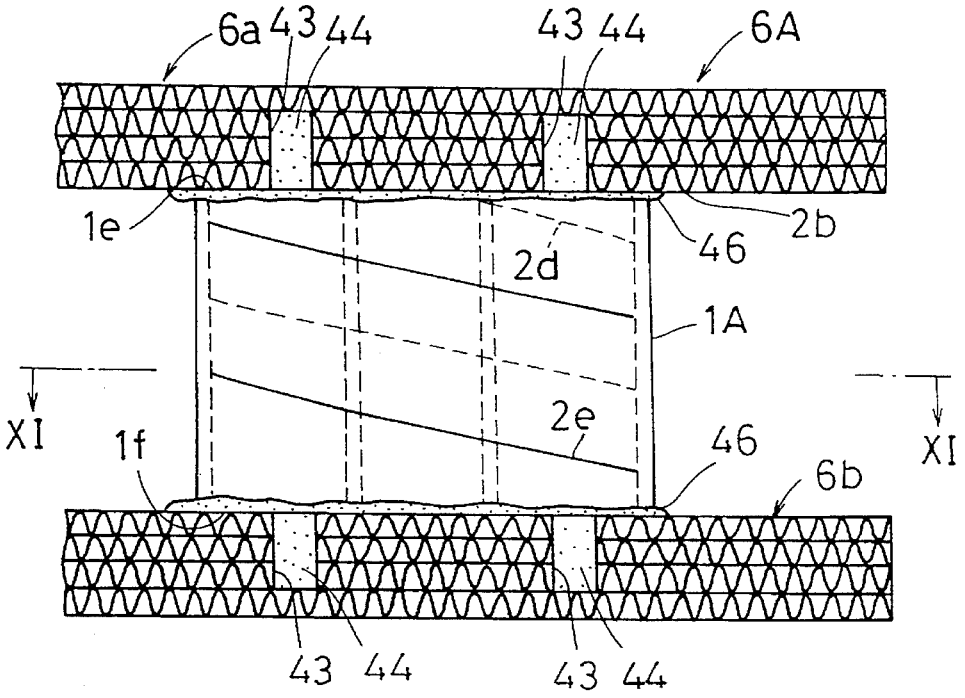
FIG. 10 is a side view, with a portion cut away, of the pallet according to an embodiment of the present invention in which means is provided to avoid an interlayer separation.

Referring now to FIGS. 10 and 11, the pallet 6A shown therein makes use of the corrugated cardboard tube 1A as a tubular corrugated cardboard leg having its opposite annular end faces 1*e* and 1*f*. As shown therein, the opposite annular end faces 1*e* and 1*f* of each tubular corrugated cardboard leg are bonded to the upper and lower tables 6*a* and 6*b*, respectively, in a manner substantially shown in FIGS. 4A and 4B.

However, each of the upper and lower tables 6*a* and 6*b* of the pallet 6A shown in FIGS. 10 and 11 is of a double-layered structure including two multiply double-lined corrugated cardboards 2A (FIG. 4C) bonded together as clearly shown in FIG. 10 which illustrates a side sectional representation of a portion of the pallet 6A with only one of the tubular corrugated cardboard legs 1A shown therein. Each of the upper and lower tables 6*a* and 6*b* of the pallet 6A is formed with a circular row of a plurality of, for example, eight, reinforcement holes 43 defined therein in a concentric relation with each of the tubular corrugated cardboard legs 1A as shown by the phantom circles in FIG. 11 and positioned so as to be completely covered by the associated annular end face 1*e* or 1*f* of the respective tubular corrugated cardboard leg 1A. These reinforcement holes 43 are used to accommodate therein an adhesive filler material 44. The adhesive filler material 44 may be a bonding material of polyvinyl acetate type mixed and kneaded a little on the firm side with a filler material quick to dry and having an affinity with the bonding material. Examples of the filler material includes, for example, finely divided pulp material such as paper, finely divided pieces of wood or sawdust. Each of the reinforcement holes 43 is preferably in the form of a blind hole so that no adhesive filler material injected thereinto does not flow through from one side to the opposite side across the thickness of the upper or lower table 6*a* or 6*b*, the depth and the transverse section of which hole 43 may be chosen depending on and/or in consideration of a particular condition.

Each of the tubular corrugated cardboard legs used in the pallet 6A is of a structure identical with the corrugated cardboard tube 1A shown in and described with reference to FIGS. 1A and 1B and FIG. 2 and, therefore, the respective tubular corrugated card board leg 1A exhibits not only a high compressive strength when subjected to the axial load acting in the axial direction thereof upon placement of contents on the upper table 6*a* of the pallet 6A, but also both of a high geometrical moment of inertia with respect to the cross-section thereof and a bending rigidity when subjected to the lateral load acting in the radial direction thereof.

The opposite annular end faces 1*e* and 1*f* of each tubular corrugated cardboard legs 1A are firmly bonded to the upper and lower tables 6*a* and 6*b*, respectively. This bonding is carried out by applying, after the adhesive filler material 44 has been filled in the reinforcement holes 43 of each circular row, the adhesive material 46 solely of polyvinyl acetate resin to the annular end faces 1e and 1*f* of each tubular corrugated cardboard leg so as to form a thin layer of adhesive material 46 thereon while bulging radially inwardly and outwardly beyond the annular contour of each annular end faces 1*e* or 1*f*, followed by a securement of each annular end face 1e or if to the associated table 6*a* or 6*b* in alignment with the reinforcement holes 43.

There is two reasons for the use of the mixture of the polyvinyl acetate type adhesive material with the filler material for the adhesive filler material 44 to be filled in the reinforcement holes 43. One is because, if the adhesive material is solely employed, the adhesive material undergoes contracts during a drying process to such an extent as to result in a recess at the top surface level thereof and the presence of the recess at the top surface level of the adhesive material filled in the holes 43 brings about an insufficient interlock between either one of the upper and lower tables 6*a* and 6*b* and the respective tubular corrugated cardboard leg 1A. The other is because the sole adhesive material is relatively slow to dry.

The finely divided pulp material such as paper pieces, which is used as the filler material, can be dissolved together with the single-lined corrugated cardboards 2 during a recovery process in which the single-lined corrugated cardboards 2 are, after having been cut into pieces, dissolved in the presence of the solvent for recovery of material for the corrugated cardboard. Also, the sawdust or finely divided wood pieces used as the filler material float on the top surface of the solvent and can therefore be removed easily. Accordingly, the pallet 6A of the present invention is excellent in that it can be recycled as is the case with the corrugated cardboard tube 1A.

The adhesive material to be mixed with the filler material to provide the adhesive filler material 44 which can be employed in the practice of the present invention may be any other resinous or non-resinous bonding material other than the adhesive material of polyvinyl acetate resin discussed hereinabove. However, if the adhesive material to be mixed with the filler material to provide the adhesive filler material 44 is of the same kind as the adhesive material 46 used to connect the tubular corrugated cardboard legs 1A to the upper and lower tables 6*a* and 6*b* (that is, if both of the adhesive material to be mixed with the filler material to provide the adhesive filler material 44 and the adhesive material 46 are made of, for example, polyvinyl acetate resin), a firm interlock between the adhesive filler material 44 and the adhesive material 46 can be achieved. In any event, according to a broad aspect of the present invention, the adhesive filler material 44, although having been described as a mixture of the adhesive material with the filler material, may be solely of the adhesive material and may not contain the filler material.

The pallet 6A according to the embodiment of the present invention shown in and described with reference to FIGS. 10 and 11 is such that the adhesive filler material 44 hardened within the reinforcement holes 43 are interlocked with the adhesive material 46 applied to the annular end faces 1e and If of the tubular corrugated cardboard legs. Therefore, even when the tubular corrugated cardboard legs 1A receive the relatively high lateral load acting in the radial direction thereof, the adhesive filler material 44 then hardened does not only resists the lateral load while acting to suppress the interlayer separation which would otherwise result from the lateral load, but also distribute a torsional force resulting from the lateral load to the upper and lower tables 6*a* and 6*b* through the adhesive filler material 44. For this reason, no concentration of the lateral load at respective joints between the annular end faces 1*e* and 1*f* of the tubular corrugated cardboard legs 1A and either one of the upper and lower tables 6*a* and 6*b* take place enough to avoid an occurrence of the interlayer separation in respective portions of the flat liners 2*b* adjacent the annular end faces 1*e* and 1*f* held in contact with the upper and lower tables 6*a* and 6*b*. It has been found that the magnitude of the lateral load at which the interlayer separation takes place is five times as compared with the structure in which the adhesive filler material 44 has been filled in the reinforcement holes 43.

Moreover, according to the embodiment of the present invention shown in FIGS. 10 and 11, since the adhesive material 46 for connecting the annular end faces 1*e* and 1*f* of the tubular corrugated cardboard legs 1A to the upper and lower tables 6*a* and 6*b* is so excessively applied to the annular end faces 1*e* and 1*f* as to bulge radially outwardly to a diameter greater than the outer diameter of each annular end face 1*e* or 1*f*, the adhesive material 46, when each tubular corrugated cardboard leg is pressed to the upper or lower tables 6*a* and 6*b* and the adhesive material 46 is subsequently hardened, forms a circular bank at an outer circular joint between the annular end face 1*e* or 1*f* of each tubular corrugated cardboard leg 1A and the upper or lower table 6*a* or 6*b* as clearly shown in FIG. 10. The presence of the circular banks of the adhesive material 46 contributes to an increase in bonding strength at the joints between the annular end faces 1*e* and 1*f* and the upper and lower tables 6*a* and 6*b*. Also, if the pulp material such as paper having a relatively great thickness is employed for the outer reinforcement member 5 glued to the outer peripheral surface of the tubular laminar structure, the tubular corrugated cardboard legs 1A can be protected from being damaged in contact with, for example, load carder pawls of a forklift truck.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, the corrugated cardboard tube 1A of the present invention can find a relatively wide range of application other than the tubular corrugated cardboard legs for the pallet 6A and the core member 1B both referred to in the foregoing description. One possible application includes leg members for a handy chair or a storage box. Even in this application, the corrugated cardboard tube 1A acts as a load bearing member for the support of the load acting axially thereof.

Accordingly, such changes and modifications are, unless they depart from the scope of the present invention as delivered from the claims annexed hereto, to be construed as included therein.

What is claimed is:

1. A pallet which comprises upper and lower tables, and a plurality of corrugated cardboard tubes, each of said corrugated cardboard tubes comprising a tubular laminar structure of single-lined corrugated cardboard, said tubular laminar structure including a plurality of strips of single-lined corrugated cardboard spirally wound into a substantially cylindrical configuration to form corresponding single-lined corrugated cardboard layers overlapping and bonded with each other in a radial direction, each of said strips of single-lined corrugated cardboard composed of an elongated liner sheet and a corrugated sheet having a plurality of parallel ridges and furrows, each of said strips of single-lined corrugated cardboard being spirally turned in a direction perpendicular to the ridges, said corrugated cardboard tubes being positioned between the upper and lower tables with opposite annular ends of each corrugated cardboard tube bonded firmly to the upper and lower tables.

2. The pallet as claimed in claim 1, wherein each of said strips of single-lined corrugated cardboard has side edges opposite to each other and is wound into the substantially cylindrical configuration with the side edges of one turn of the respective strip of single-lined corrugated cardboard held in abutment with, but neither overlapped with nor spaced from, the adjacent side edges of the next succeeding turn of the respective strip of single-lined cardboard.

3. The pallet as claimed in claim 1, wherein each of said strips of single-lined corrugated cardboard is wound with the corrugated sheet and the liner sheet oriented radially inwardly and radially outwardly of the corrugated cardboard tube, respectively.

4. The pallet as claimed in claim 1, further comprising a reinforcement member bonded to at least one of a radially outer surface of the outermost one of the single-lined corrugated layers and a radially inner surface of the innermost one of the single-lined corrugated layers.

5. The pallet as claimed in claim 4, wherein said reinforcement member comprises a plurality of tapes of paper wound into a substantially cylindrical configuration in overlapping relation with each other in a direction radially thereof.

6. The pallet as claimed in claim 1, wherein the ridges of the corrugated sheet forming a part of each single-lined corrugated cardboard layer is inclined relative to a longitudinal axis of the corrugated cardboard tube.

7. The pallet as claimed in claim 1, wherein each of said upper and lower tables comprises a flat laminar structure of corrugated cardboard including a plurality of flat webs of corrugated cardboard bonded together, said flat laminar structure having a plurality of reinforcement holes defined therein in a predetermined pattern corresponding to the shape of the annular end of each corrugated cardboard tube so as to extend inwardly thereof, each of said reinforcement holes being filled with an adhesive filler material such that the annular end of each corrugated cardboard tube can be firmly interlocked with the associated table by means of a deposit of the adhesive filler material.

8. The pallet as claimed in claim 7 wherein the adhesive filler material filled in each reinforcement hole is a resinous adhesive material mixed with a filler material.

9. The pallet as claimed in claim 7 wherein the adhesive filler material filled in each reinforcement hole contains an adhesive material of the same kind as an adhesive material used to connect the opposite annular end of each corrugated tube with the upper and lower tables.

* * * * *